United States Patent [19]

Heile

[11] Patent Number: 4,512,908

[45] Date of Patent: Apr. 23, 1985

[54] HIGHLY ALKALINE LIQUID WAREWASHING EMULSION STABILIZED BY CLAY THICKENER

[75] Inventor: Bernard J. Heile, Apple Valley, Minn.

[73] Assignee: Economics Laboratory, Inc., St. Paul, Minn.

[21] Appl. No.: 510,947

[22] Filed: Jul. 5, 1983

[51] Int. Cl.[3] ..... C11D 7/56

[52] U.S. Cl. ..... 252/160; 252/99; 252/135; 252/140; 252/174.25; 252/186.26; 252/DIG. 14

[58] Field of Search ..... 252/160, 140, 99, DIG. 14, 252/173, 174.25, 187.26, 135

[56] References Cited

U.S. PATENT DOCUMENTS

| | | | |
|---|---|---|---|
| 3,671,440 | 6/1972 | Sabatelli et al. | 252/103 |
| 4,005,027 | 1/1977 | Hartman | 252/173 |
| 4,147,650 | 4/1979 | Sabatelli et al. | 252/103 |
| 4,397,755 | 8/1983 | Brierley et al. | 252/140 |
| 4,431,559 | 2/1984 | Ulrich | 252/99 |

FOREIGN PATENT DOCUMENTS 2810187 9/1978 Fed. Rep. of Germany .

OTHER PUBLICATIONS

LaPorte, Inc.,—Technical Information L.47: Laponite RD and RDS.

Vanderbilt Minerals—"What is Veegum?".

The Merck Index, (10th ed., 1983), at p. 895.

*Primary Examiner*—Paul Lieberman

*Assistant Examiner*—Hoa Van Le

*Attorney, Agent, or Firm*—Merchant, Gould, Smith, Edell, Welter & Schmidt

[57] ABSTRACT

A stable, highly alkaline liquid warewashing emulsion composition can comprise an effective hardness sequestering amount of a sodium condensed phosphate, a detergent building amount of sodium hydroxide, an effective stain-removing amount of an inorganic source of chlorine, and an emulsion stabilizing amount of a hectorite clay thickener, which can be used in wash water at concentrations of less than about 2% to clean and destain tableware.

8 Claims, No Drawings

HIGHLY ALKALINE LIQUID WAREWASHING EMULSION STABILIZED BY CLAY THICKENER

FIELD OF THE INVENTION

The invention relates to highly alkaline liquid cleaner emulsions, stabilized by a clay thickener, that can be accurately metered into dishwashing machines to clean and destain tableware, including glassware, flatware, and hollowware.

BACKGROUND OF THE INVENTION

Highly alkaline cleaning agents are well known for their applicability in institutional and household dishwashing machines. The highly alkaline cleaners commonly contain constituents that can act to prevent deposition of or act to remove inorganic salt residues, can act to clean dishes of organic or bio-organic food residues, and can act to destain. The greater amount of cleaning compositions consumed consist of solid cleaners. However, the use of liquid cleaners has generated substantial interest in recent years because of the many advantages of liquid detergents. Caustic dusts that are generated by solids which can cause personal health problems are absent in liquids. Liquid cleaners can be injected into closed systems in accurate, precise measured doses. Liquid cleaners are homogeneous, require no heat of dissolution, and are substantially instantly solubilized, an important factor in low temperature cleaning. Liquid cleaners can exist in solution form or as a suspension, slurry or emulsion.

The production of highly concentrated liquid cleaners is a desired goal since a more concentrated cleaner can be handled economically in smaller containers, less water can be consumed in manufacture, and can be relied on to deliver to the wash water effective amounts of alkaline cleaning agents. We have found, however, that there can be limits under certain conditions upon the concentration of cleaning materials that can be attained in stable aqueous solutions or suspensions. In many cases, less than 15 wt-% of sodium cleaners in a mixture of sodium condensed phosphate hardness sequestering agent and sodium hydroxide can be maintained in aqueous solution. In concentrated cleaners in the form of an emulsion, thickeners can be needed in the cleaner, and substantial limits on the amount of hardness sequestering agent and base can occur. The consequence of exceeding the concentration limits of these cleaners is the production of unstable emulsions which upon storage can result in the precipitation or separation of solids. The use of a separated liquid cleaner can result in the introduction into the wash water of very low concentrations of cleaner or can result in plugging and clogging of pump lines and filters by the presence of substantial amounts of precipitated solids.

One method of forming a stable solution or suspension of concentrated highly alkaline cleaners is to use a polyelectrolyte thickening agent such as sodium polyacrylate or polyacrylic acid. Sabatelli et. al., U.S. Pat. Nos. 3,671,440 and 4,147,650 both teach liquid warewashing cleaners formulated with alkali metal hydroxide, alkali metal pyrophosphate, alkali metal hypochlorite, sodium or potassium condensed phosphate, and other inorganic cleaners in combination with a polyelectrolyte thickener such as polyacrylic acid, polyacrylate, polyacrylamide, etc. We have found, however, that the presence of organic polyelectrolytes in the system containing available chlorine can be a substantial drawback. The available chlorine can interact and degrade the organic polyelectrolyte, polyacrylate, resulting in both the consumption of available chlorine which is essential for destaining properties, and the destabilization of the emulsion which relies on the polyacrylate thickener for stability. We have also found that many other organic and inorganic thickening agents are unsatisfactory in forming stable alkaline liquid emulsions. Further, in certain systems as much as 10 wt-% of the organic polyelectrolyte may be necessary in order to form a stable emulsion.

Accordingly, a substantial need exists for a highly alkaline liquid cleaner composition having cleaning, water treating and destaining properties in the form of a stable emulsion having a thickener which does not interact with the source of chlorine.

BRIEF SUMMARY OF THE INVENTION

We have found that a stable emulsion of highly alkaline cleaning components can be formed by suspending in soft water a sodium condensed phosphate hardness sequestering agent, sodium hydroxide, and an inorganic source of available chlorine using a magnesium oxide-silicon dioxide clay thickening agent. We have found that the inorganic clay thickening agent (1) forms a stable emulsion of the cleaning components at a low concentration of clay-thickener, (2) does not interact with the available chlorine in the system to reduce chlorine concentration and (3) is not consumed by the available chlorine.

DETAILED DISCUSSION OF THE INVENTION

The liquid, highly alkaline stain removing emulsion compositions of the invention are formed from a sodium condensed phosphate hardness sequestering agent, sodium hydroxide, an inorganic source of chlorine and a clay thickener.

The sodium condensed phosphate hardness sequestering agent component functions as a water softener, a cleaner, and a detergent builder. Linear and cyclic condensed phosphates commercially available commonly have a $Na_2O:P_2O_5$ mole ratio of about 1:1 to 2:1 and greater. Typical polyphosphates of this kind are the preferred sodium tripolyphosphate, sodium hexametaphosphate, tetrasodium pyrophosphate as well as corresponding potassium salts of the phosphates and mixtures thereof. The particle size of the phosphate is not critical, and any finely divided or granular commercially available product can be employed. Sodium tripolyphosphate is the most preferred hardness sequestering agent for reasons of its ease of availability, low cost, and unequaled cleaning properties. Sodium tripolyphosphate is the phosphate of choice in the emulsion cleaners, since it can sequester calcium and/or magnesium, providing water softening properties. It contributes to the removal of soil from hard surfaces and keeps soil in suspension. It has little corrosive action on washing machines or industrial equipment, and is low in cost compared to other water conditioners. As we have stated above, sodium tripolyphosphate has relatively low solubility in water (about 14 wt-%) and its concentration must be increased using means other than solubility. We believe that there is an interaction between condensed phosphate water conditioning agents, sodium hydroxide and the $MgO-SiO_2$ clay suspending-thickening agents used in the invention which results in a stable, white, smooth, pumpable emulsion which is easily adapted to metering systems of dishwashing machines.

The caustic alkali content of the liquid, highly alkaline cleaners of this invention can be derived from caustic soda which can be used in both liquid (about 10 to 60 wt-% aqueous solution) or in solid (powdered or pellet) form. The preferred form used in increasing the alkali content of the liquid cleaners is commercially available sodium hydroxide, which can be obtained in aqueous solution at concentrations of about 50 wt-% and in a variety of solid forms of varying particle size.

The highly alkaline destaining cleaning emulsions of this invention can also contain a source of available chlorine which acts as a bleaching or destaining agent. Any suitable bleaching agent which yields available chlorine in the form of hypochlorite or $Cl_2$ can be used in the highly alkaline cleaning composition. Both organic and inorganic sources of available chlorine are useful. Examples of the chlorine source include alkali metal and alkaline earth metal hypochlorite, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate, sodium dichloroisocyanurate dihydrate, 1,3-dichloro-5,5-dimethylhydantoin, N-chlorosulfamide, Chloramine T, Dichloramine T, Chloramine B and Dichloramine B. The preferred class of sources of available chlorine comprise inorganic chlorine sources such as sodium hypochlorite, monobasic calcium hypochlorite, dibasic calcium hypochlorite, monobasic magnesium hypochlorite, dibasic magnesium hypochlorite, and mixtures thereof. The most preferred source of available chlorine comprises sodium hypochlorite, mono and dibasic calcium hypochlorite, for reasons of availability, low cost and highly effective bleaching action.

We have discovered that a specific organic clay thickening agent provides stability of available chlorine concentrations in highly alkaline cleaning emulsion systems and provides a storage stable emulsion of the highly alkaline cleaners. The clay thickening-suspending agents which function to form the stable, highly alkaline emulsions of the invention are magnesium oxide-silicon dioxide clays wherein the silicon dioxide:-magnesium ratio is within the range of about 10:1 to 1:1. The preferred class of clay thickening-suspending agents comprise "synthetic" clays. A synthetic clay is a clay made by combining the individual components from relatively pure materials in production equipment to form a physical mixture which interacts to form a clay-like substance. Non-synthetic or natural clays are minerals which can be derived from the earth surface. A preferred inorganic synthetic clay combines silicon dioxide, magnesium dioxide, and alkali metal oxide wherein the ratio of silicon dioxide:magnesium oxide is about 1:1 to 10:1 and the ratio of silicon dioxide to alkali metal oxide is about 1:0.5 to 1:0.001. The alkali metal hydroxide can comprise lithium oxide ($Li_2O$), sodium oxide ($Na_2O$), potassium oxide ($K_2O$), etc. and mixtures thereof. The most preferred clay thickening-suspending agent comprises a smectite or hectorite-like inorganic synthetic clay comprising silicon dioxide, magnesium oxide, sodium oxide, lithium oxide, and structural water of hydration wherein ratios of $SiO_2$:MgO:$Na_2O$:-$Li_2O$:$H_2O$ comprises about 25–75:20–40: 1–10:0.1–1:-1–10. The clays appear to be white, finely divided solids having a specific gravity of about 2–3, an apparent bulk density of about 1 gram per milliliter at 8% moisture, and an absorbence (optical density) of a 1% dispersion in water of about 0.25 units.

In somewhat greater detail, the highly alkaline emulsion cleaning systems of this invention contain an effective amount of a sodium condensed phosphate hardness sequestering agent, sodium hydroxide, an inorganic source of available chlorine, and a magnesium silicate clay thickening suspending agent.

The cleaning compositions are suspended in water. Soft or deionized water is preferred for the reason that inorganic ($Ca^{++}$, or $Mg^{++}$) cations in service or tap water can combine with and reduce the efficiency of the hardness sequestering agents and can interfere in the formation of a stable emulsion.

The hardness sequestering agent can be present in the emulsion in an effective hardness sequestering amount which comprises about 10 to about 35 wt-% based on the total composition. Preferably the hardness sequestering sodium condensed phosphate can be present in an amount of about 15 to 30 wt-%, and most preferably, for reasons of high concentration, effective cleaning properties and low cost, in amounts of about 20 to 30-wt% of the composition.

Caustic builders are commonly added to the emulsion cleaner of the invention and are present in amounts of about 5 to 25 wt-%. Caustic can be added to the emulsion cleaner in solid powders or pellets or in the form of commercially available 50 wt-% caustic concentrates. Preferably the caustic is present in the emulsion cleaner in concentrations of about 5 to 15 wt-% (dry basis), and most preferably for reasons of cleaning activity, cost and ease of manufacture, sodium hydroxide is present in the emulsion cleaner at a concentration of about 10 to about 15 wt-% (dry basis).

The concentration of the chlorine source must be sufficient to provide destaining of dishes in order to remove objectionable tea, coffee, and other generally organic stain materials from the dish surfaces. Commonly in the alkaline emulsion cleaners the concentration of the chlorine yielding substance is about 2 to about 35 wt-% of the total composition. The preferred concentration of the chlorine comprises about 15 to about 30 wt-%, and most preferably for reasons of effective destaining at low cost, about 20 to about 30 wt-% of the emulsion cleaner composition.

An inorganic magnesium oxide-silicon dioxide clay thickening-suspending agent is commonly present in the emulsion cleaner at a sufficient concentration to result in the smooth, stable suspension or emulsion of the highly alkaline cleaning composition. An effective amount of the clay comprises from about 0.05 to about 5 wt-% of the composition. Preferably, the suspending-thickening clay is present at a concentration of about 0.1 to about 2 wt-% of the highly alkaline emulsion cleaning composition, and most preferably for reasons of low cost and high thickening and suspending activity, the synthetic hectorite or smectite clay is present in an amount of about 0.2 to 1.0 wt-%.

The highly alkaline liquid emulsion cleaning composition of this invention can be made by combining the components in suitable mixing or agitating equipment which are lined or protected from the highly caustic bleaching nature of the components and agitating the components until a smooth, stable emulsion is formed.

A preferred method for forming the stable emulsions of the invention comprises first forming a stable suspension of the clay thickening suspending agent, and then adding the additional components slowly until a stable emulsion is formed. One precaution involves the addition of caustic which must be added slowly to avoid destabilizing or shocking the clay suspension.

The highly alkaline cleaning emulsion can be packaged in containers holding any conveniently usable volume of liquid material. For institutional warewashing, containers having from about 1 quart to 10 gallons in capacity can be used. For household dishwashing, containers having a capacity of from about 6 oz. to 1 gallon can be used. Preferably the containers are made from materials that are resistant to the effects of the highly alkaline compositions and the active chlorine in the cleaner. Packaging materials which can be used include common plastic materials such as polyethylene terephthalate, polyethylene and polypropylene, wax coated cardboard, coated metal containers, and others. The highly alkaline cleaning emulsions of this invention can be added to wash water in dishwashing machines using pumping means having the ability to deliver highly accurate volumes of the emulsion to the wash water. The concentration of the components of the highly alkaline emulsion cleaner in the wash water necessary to obtain a destaining effect comprises about 250 to 1,000 parts of sodium tripolyphosphate per million parts of wash water, about 100 to 1,000 parts of sodium hydroxide per million parts of wash water, and about 25 to 100 parts of active chlorine per million parts of wash water. Depending on the concentration of the active ingredients in the highly alkaline emulsion cleaner of this invention, the emulsion cleaner can be added to wash water at a total concentration of all components, including water, of about 0.05 to 12 wt-% of the wash water. Preferably, using a convenient concentrate of the emulsion cleaner, about 0.1 to about 0.5 wt-% of the cleaner can be added to the wash water to obtain acceptable results. Most preferably the emulsion cleaner of the invention can be added to wash water at a rate of about 0.1 to about 0.3 wt-% for reasons of ease of metering, high destaining and desoiling activity and low cost. The highly alkaline cleaning composition of this invention can also include other typical additives such as dyes, perfumes, fragrances, etc. which do not significantly affect the cleaning properties or the stability of the emulsion.

In use, the emulsion of the invention is added to wash water at a temperature of from about 120° F. to about 200° F. and preferably is used in wash water having a temperature of 140° F. to 160° F. The cleaning solution is applied in the wash water to the surfaces of articles to be cleaned. Although any technique common in the use of available ware washing equipment can be used, the cleaning compositions of this invention are specifically designed for and are highly effective in cleaning highly soiled and stained cooking and eating utensils. High effective cleaning with low foaming is obtained in institutional ware washing machines. Commonly after contact with the cleaning solutions prepared from the emulsion of this invention, the ware is rinsed with water and dried generally to an unspotted finish. In the use of the highly alkaline cleaner of this invention, we have experienced that food residues are effectively removed and clean dishes and glassware exhibit less spotting and greater clarity than is found in many conventional cleaning compositions, both of a solid and liquid nature.

The invention is further illustrated by the following specific Examples, which should not be used in limiting the scope of the invention. In the Examples, which contain a best mode, all parts are in parts by weight unless otherwise specifically indicated.

EXAMPLE I

Into a stainless steel container having a volume of 555 liters equipped with a propeller stirrer, heater, cooling mechanism, and vent was placed 1027 liters of soft water having a conductivity of about 0.5 MHO and 2.8 kilograms of Laponite RDS, a magnesium silicate hectorite-clay having the approximate following composition:

| Analysis | Percent W/W |
|---|---|
| $SiO_2$ | 59.8 |
| MgO | 27.2 |
| $Na_2O$ | 4.4 |
| $Li_2O$ | 0.8 |
| $H_2O$ (structural) | 7.8 |

wherein the clay has the following approximate idealized formula: $Na_{0.22}Li_{0.5}Mg_{5.64}Si_8O_{20}(OH)$. The mixture was stirred until the clay was suspended uniformly in the soft water. Into the clay suspension was placed 80.5 kilograms of sodium metasilicate pentahydrate and 277.5 liters of a 50 wt-% aqueous sodium hydroxide solution. The sodium hydroxide was added slowly to avoid shocking the clay suspending agent. Into the clay-sodium hydroxide mixture was slowly added 11 kilograms of sodium tripolyphosphate and the mixture was agitated until smooth. Into the smooth mixture was added 111 liters of a 10% active aqueous solution of sodium hypochlorite. The mixture was agitated until a smooth thick, white emulsion formed. The material was drawn from the mixing equipment and stored in 5 gallon plastic containers.

The above product was tested for stability of chlorine availability and viscosity by maintaining the composition for 38 days at 40° F., ambient temperatures and 100° F. while measuring the available chlorine, loss of available chlorine, and viscosity, initially, at 14 days, and after 38 days.

TABLE 1

High Temperature 10-Cycle Glass Filming Evaluation

| | REDEP | | MILK | | TOMATO JUICE | |
|---|---|---|---|---|---|---|
| Formula | Film Rating | Spotting Rating | Film Rating | Spotting Rating | Film Rating | Spotting Rating |
| City Water at .2% Dtg. Conc. without Soil | | | | | | |
| Product | 2.5 | 1 | 2.0 | 1 | 1.5 | 1 |
| of Ex. 1 | 2.5 | 1 | 2.5 | 1 | 1.5 | 1 |
| 7 grains | 4.0 | 1 | 3.5 | 1 | 2.5 | 1 |
| | 2.5 | 1 | 2.5 | 1 | 4.0 | 1 |
| Avg. | 2.88 | 1 | 2.63 | 1 | 2.38 | 1 |
| Acrylate | 1.5 | 1 | 3.5 | 3 | 2.0 | 2 |
| Slurry* | 1.5 | 1 | 2.0 | 4 | 1.5 | 2 |
| 7 grains | 3.0 | 4 | 2.0 | 3 | 1.5 | 2 |
| | 3.0 | 4 | 1.5 | 3 | 1.5 | 3 |
| Avg. | 2.25 | 2.5 | 2.25 | 3.25 | 1.63 | 2.25 |
| Acrylate | 3 | 3 | 2 | 3 | 2 | 2 |
| Emulsion | 3 | 3 | 2 | 3 | 2 | 2 |
| Formula** | 2 | 5 | 2 | 4 | 2 | 2 |
| 7 grains | 2 | 5 | 2 | 3 | 1.5 | 2 |
| Avg. | 2.5 | 4.0 | 2 | 3.25 | 1.88 | 2 |
| Well Water at .2% Dtg. Conc. without Soil | | | | | | |
| Product | 3.5 | 1 | 4 | 1 | 2 | 1 |
| of Ex. 1 | 3.5 | 1 | 4 | 1 | 2 | 1 |
| 13 | 4.0 | 1 | 4 | 1 | 4 | 1 |

TABLE 1-continued

| High Temperature 10-Cycle Glass Filming Evaluation | | | | | | |
|---|---|---|---|---|---|---|
| | REDEP | | MILK | | TOMATO JUICE | |
| Formula | Film Rating | Spotting Rating | Film Rating | Spotting Rating | Film Rating | Spotting Rating |
| grains | 3.5 | 1 | 3.5 | 1 | 4 | 1 |
| Avg. | 3.63 | 1 | 3.88 | 1 | 3.0 | 1 |
| Acrylate | 3.5 | 1 | 4 | 2 | 2 | 2 |
| Slurry* | 4 | 1 | 4 | 2 | 2 | 2 |
| 13 grains | 4 | 1 | 2.5 | 2 | 2.5 | 2 |
| | 4 | 1 | 2 | 2 | 2.5 | 2 |
| Avg. | 3.88 | 1 | 3.13 | 2 | 2.25 | 2 |
| Acrylate | 2.5 | 1 | 2 | 2 | 2 | 1 |
| Emulsion | 2.5 | 1 | 2 | 2 | 2 | 1 |
| Formula** | 2.5 | 1 | 3 | 2 | 2 | 1 |
| 13 grains | 2.5 | 1 | 3.5 | 2 | 2 | 1 |
| Avg. | 2.5 | 1 | 2.63 | 2 | 2 | 1 |
| Typical*** | 2 | 2 | 3.5 | 3 | 1.5 | 2 |
| Liquid | 3.5 | 4 | 3.5 | 3 | 3.5 | 3 |
| Solution | 3.5 | 5 | 3.5 | 3 | 2.0 | 3 |
| 13 grains | 3.5 | 5 | 3.5 | 4 | 2.0 | 4 |
| Avg. | 3.13 | 4.0 | 3.5 | 3.25 | 2.25 | 3.0 |

Ratings:
1 = Clean
2 = Slight
3 = Moderate
4 - Heavy-Moderate
5 = Heavy

TABLE 2

| Cleaning of Tea Stains From Plastic Cups | | | | | |
|---|---|---|---|---|---|
| Cup No. | First Cycle | Second Cycle | Third Cycle | Fourth Cycle | Fifth Cycle |
| Using Composition of Example I | | | | | |
| 1 | 1 | 2 | 1 | 1 | 1 |
| 2 | 1 | 2 | 1 | 1 | 1 |
| 3 | 1 | 2 | 2 | 1 | 1 |
| Avg. | 1 | 2 | 1.33 | 1 | 1 |
| Using Acrylate Slurry* | | | | | |
| 7 | 2 | 3 | 4.5 | 5 | 5 |
| 8 | 2 | 3 | 4 | 4 | 5 |
| 9 | 1 | 3 | 4 | 4 | 4 |
| Avg. | 1.67 | 3 | 4.16 | 4.33 | 4.66 |
| Using Acrylate Emulsion** | | | | | |
| 4 | 4 | 5 | — | — | — |
| 5 | 4 | 5 | — | — | — |
| 6 | 4 | 5 | — | — | — |
| Avg. | 4 | 5 | — | — | — |
| Using Typical Liquid Solution*** | | | | | |
| 10 | 4 | 5 | — | — | — |
| 11 | 4 | 5 | — | — | — |
| 12 | 4 | 5 | — | — | — |
| Avg. | 4 | 5 | — | — | — |

TABLE 3

| Cleaning of Tea Stains From China Cups | | | | | |
|---|---|---|---|---|---|
| Cup No. | First Cycle | Second Cycle | Third Cycle | Fourth Cycle | Fifth Cycle |
| Using Composition of Example I | | | | | |
| 5 | 1 | 1 | 1 | 1 | — |
| 6 | 1 | 1 | 1 | 1 | — |
| 9 | 1 | 1 | 1 | 1 | — |
| Avg. | 1 | 1 | 1 | 1 | — |
| Using Acrylate Slurry* | | | | | |
| 24 | 1 | 1 | 1 | 1 | — |
| 25 | 1 | 1 | 1 | 1 | — |
| 28 | 1 | 1 | 1 | 1 | — |
| Avg | 1 | 1 | 1 | 1 | — |
| Using Acrylate Emulsion** | | | | | |
| 10 | 3 | 3 | — | — | — |
| 11 | 3 | 3 | — | — | — |
| 17 | 3 | 4 | — | — | — |
| Avg. | 3 | 3.33 | — | — | — |

TABLE 3-continued

| Cleaning of Tea Stains From China Cups | | | | | |
|---|---|---|---|---|---|
| Cup No. | First Cycle | Second Cycle | Third Cycle | Fourth Cycle | Fifth Cycle |
| Using Typical Liquid Solution*** | | | | | |
| 32 | 3 | 4 | — | — | — |
| 34 | 3 | 4 | — | — | — |
| 38 | 3 | 4 | — | — | — |
| Avg. | 3 | 4 | — | — | — |

*Slurry formula 25% sodium hydroxide (50 wt % aqueous), 20% sodium tripolyphosphate, 5% sodium polyacrylate, 20% sodium hydroxide, balance soft water.
**Acrylate emulsion formula 77.5% sodium hydroxide (50 wt % aqueous), 9.5% phosphonate (50%) triphosphonomethylamine, 7.2% sodium polyacrylate (50 wt % active aqueous), balance soft water.
***Liquid solution cleaner 52% sodium hydroxide (50 wt % aqueous), 10% sodium polyacrylate (50 wt % aqueous), balance soft water.

TABLE 4

| Stability Testing at 40° F. | | | | |
|---|---|---|---|---|
| Time Period | Percent Available Chlorine | Percent Available Chlorine Loss | Viscosity at Storage Temperature | Viscosity at Ambient |
| Day 0 | 1.81 | — | 810 cP | — |
| Day 14 | 1.72 | 4.97 | 2056 cP | 2044 cP |
| Day 38 | 1.67 | 7.73 | 2080 cP | 1536 cP |

TABLE 5

| Stability Testing at Ambient | | | | |
|---|---|---|---|---|
| Time Period | Percent Available Chlorine | Percent Available Chlorine Loss | Viscosity at Storage Temperature | Viscosity at Ambient |
| Day 14 | 1.54 | 14.92 | 1614 cP | — |
| Day | 1.28 | 29.28 | 2136 cP | — |

TABLE 6

| Stability Testing at 100° F. | | | | |
|---|---|---|---|---|
| Time Period | Percent Available Chlorine | Percent Available Chlorine Loss | Viscosity at Storage Temperature | Viscosity at Ambient |
| | 1.14 | 37.02 | 1042 cP | 1372 cP |
| | 0.67 | 62.98 | 780 cP | 1244 cP |

Tables 1-6 show that a composition of the invention has both the ability to remove stubborn tea stains, milk and tomato juice soil, prevent redeposition of food soil, and at the same time maintain chlorine and viscosity stability.

COMPARATIVE EXAMPLE I-A

Into a suitable mixing container was placed about 14 parts of water and about 1 part of ICS-1, a polymeric acrylic thickening agent. The mixture was stirred until smooth, and into the smooth mixture was added 45 parts of potassium tripolyphosphate, 20 parts of potassium hydroxide, and 20 parts of sodium hypochlorite. The mixture was stirred until uniform and stored in a glass container overnight at 100° F.

COMPARATIVE EXAMPLE I-B

Example I-A was repeated except that 3 parts of ICS-1 was used in place of the 1 part of ICS-1, and 11 parts of water were used in place of 14 parts of water.

COMPARATIVE EXAMPLE I-C

Example I-A was repeated except that 5 parts of ICS-1 was used in place of 1 part of ICS-1, and 9 parts of water was used in place of the 14 parts of water.

After the products of Examples I-A through C were mixed until smooth they neither thickened nor maintained solids in suspension.

COMPARATIVE EXAMPLE II

The preparation of I-A through C was repeated except that veegum HS was substituted for ICS-1. The product made using the Veegum thickening agent thickened the highly alkaline cleaning material. Upon exposure to highly alkaline materials overnight, the thickening agent deteriorated, resulting in an unusable mixture.

COMPARATIVE EXAMPLE III

Example I-A through C was repeated except CAB-O-SIL TM M-5 silica thickener was substituted for the ICS-1. After mixing the CAB-O-SIL TM precipitated immediately.

COMPARATIVE EXAMPLE IV AND V

Example I-A through C was repeated except that van gel L was substituted for ICS-1. The resulting product after mixing thickened by the van gel L product separated overnight. The van gel B product thickened but separated and precipitated overnight.

COMPARATIVE EXAMPLE VI

Example I-A through C was repeated except xanthan gum was substituted for ICS-1. The product thickened but the thickening agent completely deteriorated overnight, leaving a useless cleaner.

COMPARATIVE EXAMPLE VI

Example I-A through C was repeated except that synthetic hectorite clay Laponite RDS was substituted for the ICS-1. At 1% a thickened but cloudy suspension resulted. At 3 and 5% the emulsion thickened, became opaque and was stable from 40°–90° F.

The foregoing description, Examples, and data are illustrative of the invention described herein and should not be used to unduly limit the scope of the invention. Since many embodiments and variations can be made while remaining within the spirit and scope of the invention, the invention resides wholly in the claims hereinafter appended.

I claim:

1. A highly alkaline composition having cleaning and stain removing properties which consists essentially of:

(a) water;

(b) 15–45% of a sodium condensed phosphate hardness sequestering agent;

(c) about 5 to 25% of sodium hydroxide or potassium hydroxide;

(d) about 2 to 35% of an inorganic source of chlorine; and, (e) about 0.2 to 5% of a hectorite clay dispersant-thickening agent incorporating silicon dioxide, magnesium oxide, sodium oxide, lithium oxide and structural water of hydration in a ratio of about 25–75:20–40:1–10:0.1–1:1–10 wherein said agent is present in an amount effective to maintain the composition as a stable liquid emulsion or dispersion which is substantially resistant to deterioration under alkaline conditions.

2. The composition of claim 1 wherein the inorganic source of chlorine comprises a hypochlorite compound, chlorinated sodium tripolyphosphate, a chlorate compound or mixtures thereof.

3. The composition of claim 1 wherein the inorganic source of chlorine comprises an alkali metal hypochlorite, an alkaline earth metal hypochlorite, or mixtures thereof.

4. The composition of claim 1 wherein the sodium condensed phosphate composition comprises sodium tripolyphosphate, tetrasodium pyrophosphate or mixtures thereof.

5. The composition of claim 1 wherein the dispersant-thickening agent is a synthetic hectorite.

6. The composition of claim 3 wherein the inorganic source of chlorine is sodium hypochlorite.

7. The composition of claim 5 wherein the synthetic hectorite is of the formula: $Na_{0.22}Li_{0.5}Mg_{5.64}Si_8O_{20}(OH)$.

8. A process for cleaning table ware comprising glass ware, flat ware and hollow ware, which are fouled or stained with food, which consists essentially of:

(a) adding to wash water having a hardness of from about 1 to about 20 grains of hardness per gallon, a sufficient amount of the composition of claim 15 to form a solution having 0.01 to about 0.5 wt-% of the highly alkaline composition to form an aqueous cleaning solution;

(b) applying the aqueous cleaning solution to table ware fouled with food or stains for a period sufficient to clean and destain the table ware; and, (c) rinsing the table ware free of the aqueous cleaning solution.

* * * * *

UNITED STATES PATENT AND TRADEMARK OFFICE

CERTIFICATE OF CORRECTION

PATENT NO. : 4,512,908

DATED : April 23, 1985

INVENTOR(S) : Bernard J. Heile

It is certified that error appears in the above–identified patent and that said Letters Patent are hereby corrected as shown below:

At Col. 10, line 43, for "claim 15" read "claim 1".

Signed and Sealed this

*Eighteenth* Day of *February 1986*

[SEAL]

*Attest:*

DONALD J. QUIGG

*Attesting Officer*

*Commissioner of Patents and Trademarks*